US008650803B2

(12) United States Patent
Robins

(10) Patent No.: US 8,650,803 B2
(45) Date of Patent: Feb. 18, 2014

(54) CLIP FOR SECURING GUTTER GUARD TO GUTTER

(75) Inventor: Evelyn M. Robins, Ruckersville, VA (US)

(73) Assignee: Leafsolution, LCC, Rochelle, VA (US)

( * ) Notice: Subject to any disclaimer, the term of this patent is extended or adjusted under 35 U.S.C. 154(b) by 0 days.

(21) Appl. No.: 13/372,568

(22) Filed: Feb. 14, 2012

(65) Prior Publication Data

US 2013/0091780 A1 Apr. 18, 2013

Related U.S. Application Data

(60) Provisional application No. 61/546,189, filed on Oct. 12, 2011.

(51) Int. Cl.
*E04D 13/00* (2006.01)

(52) U.S. Cl.
USPC ..... 52/12; 52/15; 248/48.1

(58) Field of Classification Search
USPC ..... 52/12, 15, 11; 248/48.2, 48.1
See application file for complete search history.

(56) References Cited

U.S. PATENT DOCUMENTS

| | | | | | |
|---|---|---|---|---|---|
| 1,491,921 | A * | 4/1924 | Rachlin | 248/48.1 |
| 1,855,241 | A * | 4/1932 | Irwin | 248/48.2 |
| 1,997,663 | A * | 4/1935 | Usinger | 248/48.1 |
| 2,144,663 | A * | 1/1939 | Petersen | 248/48.1 |
| 2,536,704 | A * | 1/1951 | Shea et al. | 248/48.2 |
| 2,710,159 | A * | 6/1955 | Gordon | 248/48.2 |
| 2,739,775 | A * | 3/1956 | Bertram | 248/48.1 |
| 3,150,851 | A * | 9/1964 | Ritchie et al. | 248/48.2 |
| 3,239,172 | A * | 3/1966 | Chalmers | 248/48.2 |
| 3,295,803 | A * | 1/1967 | Blayden | 248/48.2 |
| 3,333,803 | A * | 8/1967 | Landis | 248/48.2 |
| 3,416,760 | A * | 12/1968 | Sauder | 248/48.2 |
| 3,864,882 | A * | 2/1975 | Lasscock | 52/11 |
| 4,241,548 | A * | 12/1980 | Rowe | 52/11 |
| 4,467,570 | A * | 8/1984 | Kriegel | 52/12 |
| 4,796,390 | A * | 1/1989 | Demartini | 52/12 |
| 5,004,191 | A * | 4/1991 | Corry | 248/48.2 |
| 5,044,581 | A * | 9/1991 | Dressler | 248/48.1 |
| 5,271,192 | A * | 12/1993 | Nothum et al. | 52/12 |
| 5,398,464 | A * | 3/1995 | Jacobs | 52/12 |
| 5,740,633 | A * | 4/1998 | Champagne | 52/11 |
| 5,899,023 | A * | 5/1999 | Byer | 52/12 |
| 7,861,980 | B1 * | 1/2011 | Verbrugge et al. | 248/48.2 |
| 2002/0073631 | A1 * | 6/2002 | Baker | 52/12 |
| 2006/0230687 | A1 * | 10/2006 | Ealer | 52/12 |
| 2008/0163561 | A1 * | 7/2008 | Lenney et al. | 52/12 |
| 2011/0099916 | A1 * | 5/2011 | Minor et al. | 52/11 |
| 2011/0126477 | A1 * | 6/2011 | Hurn | 52/12 |

* cited by examiner

*Primary Examiner* — Joshua J Michener
*Assistant Examiner* — Babajide Demuren
(74) *Attorney, Agent, or Firm* — Nixon & Vanderhye PC

(57) ABSTRACT

A clip for removably securing the front lip of a gutter guard having holes therethrough to the underlying front lip of a gutter having a downwardly and forwardly extending end portion. The clip comprises an elongated body with a forwardly and upwardly extending first tab at a front end thereof and a rearwardly extending second tab at a rear end thereof. The first tab can be inserted through a first hole at the front of the gutter guard with the body in an upwardly extending first position so that the first tab is located adjacent to and beneath the end portion of the gutter. The body can then be rotated downwardly toward the gutter guard to a second position wherein the first tab is moved upwardly to engage the end portion of the gutter and the second tab is received within a second hole in the gutter guard.

15 Claims, 6 Drawing Sheets

CLIP FOR SECURING GUTTER GUARD TO GUTTER

CROSS REFERENCE TO RELATED APPLICATION

This application claims the priority of provisional patent application No. 61/546,189, filed on Oct. 12, 2011.

BACKGROUND OF THE INVENTION

1. Field of the Invention

The present invention relates to a clip for a gutter guard and, more particularly, to a clip for removably securing the front lip or portion of a gutter guard to the front depending lip of a gutter.

2. Description of the Related Art

Gutters are open-top channels that collect and direct water away from a building and its foundation. The opening to the gutter channel must remain unobstructed in order for the gutter to function properly. It is common for debris, such as leaves, cones, seeds, pine needles and the like, to collect and block water flow. Obstruction of the gutter channel causes the gutter to overflow and become ineffective. Many people clean their gutters regularly as part of a preventive maintenance program, while others resort to such devices as covers and guards in an attempt to shield the gutter from the accumulation of debris in the channel.

Many of the gutter guards use a single wire layer to cover the open top of the gutter. Other guards combine a wire layer with a mesh layer to keep debris out. The guard helps prevent large debris, such as cones or seeds, from settling in the gutters. However, smaller particles often slip past such layers. The structure of the guards is generally flat so that the layers lay flat above the opening. Sometimes the integrity of the guard cannot be maintained against heavy debris or debris that has collected and settled on the guard over time.

A new and improved gutter guard that is a subject of a pending patent application comprises elongated panels of any suitable length, such as 96 inches, which may be mounted end to end on a gutter and may be formed of any suitable material such as aluminum. Each panel is of a perforated, undulating or sinusoidal wave construction comprising a plurality of longitudinally extending, laterally spaced, elongated raised areas for retarding water flow across the panel with recessed channels therebetween. The perforations in the nature of first holes in the panel are closely spaced in longitudinally aligned relation and also in offset lateral relation, and are disposed in the longitudinally extending recessed channels and in the portions of the longitudinally extending raised areas facing the rear of the panel that is intended to be mounted on a portion of a gutter that is attached or to be attached to the adjacent portion of a building or the like near the roof thereof.

The first holes are of a novel shape, such as a tear drop or the like, having a narrow end portion facing the rear of the panel and expanding outwardly toward the front of the panel. In this manner, rain water flowing from the rear to the front of the panel when it is mounted on a gutter is retarded by the elongated raised areas and spread by the outwardly expanding first holes as it rolls across the panel and thus decreases the water sheet thickness at the first holes to allow the water to drop more readily through the first holes into the gutter.

Near the front of the panel, which is intended to be mounted on the front portion of a gutter, there are provided a plurality of longitudinally extending and aligned second openings that are generally perpendicular to the transversely or laterally extending first holes in the channels and in the raised areas of the panel. The longitudinally extending second openings are intended to catch any rain water that may have flowed across the panel without falling through the first holes.

In accordance with existing practice and the prior art, the front lip of the gutter guard is attached to the adjacent depending front lip of the gutter by screws or rivets which is time consuming and involves the penetration of both the gutter guard and the gutter. The clip of the present invention serves to removably secure the front lip of the gutter guard to the depending front lip of the gutter without the requiring the use of any connector members such as screws or rivets, or the penetration of the guard and/or the gutter.

SUMMARY OF THE INVENTION

The new and improved clip of the present invention is formed of a flexible and resilient material, such as spring stainless steel, and comprises an elongated body having one or more upwardly curved first tabs at the front end thereof and one or more elongated second tabs at the rear end thereof. A depending guide tab is located at the front end of the clip body. The clip body has a plurality of holes therethrough of any suitable or desired number, configuration and arrangement for allowing rain water to pass through the clip body and into an underlying gutter guard and gutter, as will be more fully described hereinafter.

The clip is constructed to be used with a gutter guard like the above described gutter guard having a perforated panel with first holes therein and second openings on or near the front lip of the gutter guard.

When the gutter guard is positioned on a gutter such that its front lip rests on the front lip of the gutter, which terminates in a downwardly and outwardly curved end portion, the first upwardly curved tab or tabs on the front end of the gutter guard are inserted through a second opening or openings at the front lip of the gutter guard and the clip is thereafter rotated and bent downwardly toward the rear of the gutter guard so that the upwardly curved first tab or tabs engage the underside of the downwardly and outwardly curved end portion of the front lip of the gutter to removably secure the front lip of the gutter guard to the adjacent front lip of the gutter. The clip is rotated downwardly until a second elongated tab or tabs on the inner end thereof are received and retained into one or more first holes in the panel of the gutter guard. As the clip is rotated downwardly to secure it in a releasably locked position, the depending guide tab at the front end thereof enters an adjacent second opening at the front lip of the gutter guard to properly align the clip body so that the second tab or tabs at the inner end thereof can enter one or more first holes in the gutter guard panel so as to be received and retained therein.

DETAILED DESCRIPTION OF THE INVENTION

Figure 1:
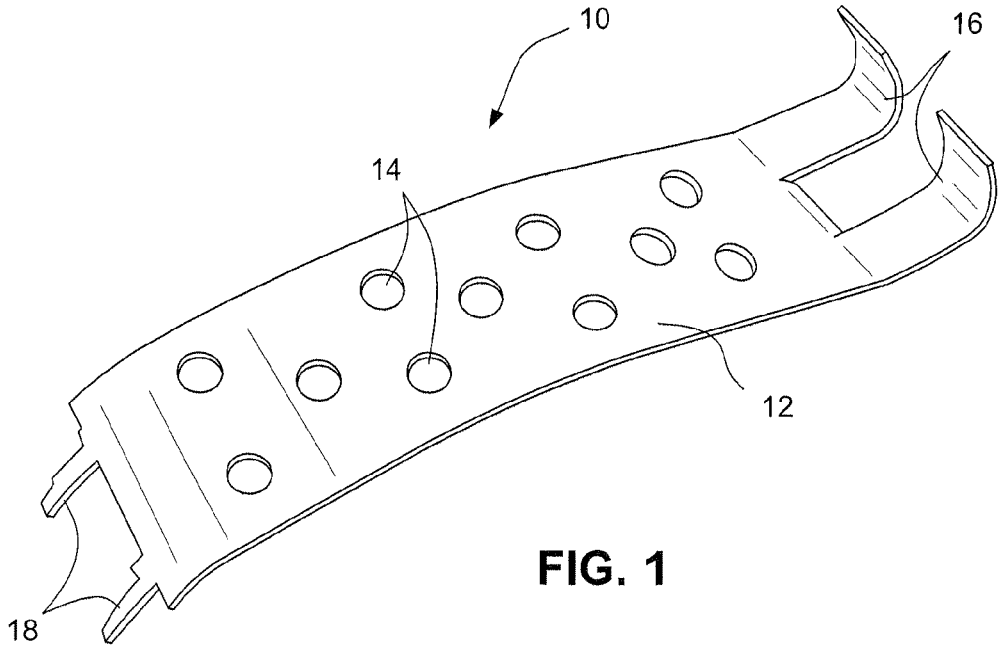
FIG. 1 is a perspective view of the top portion of the clip of the present invention.
Figure 2:
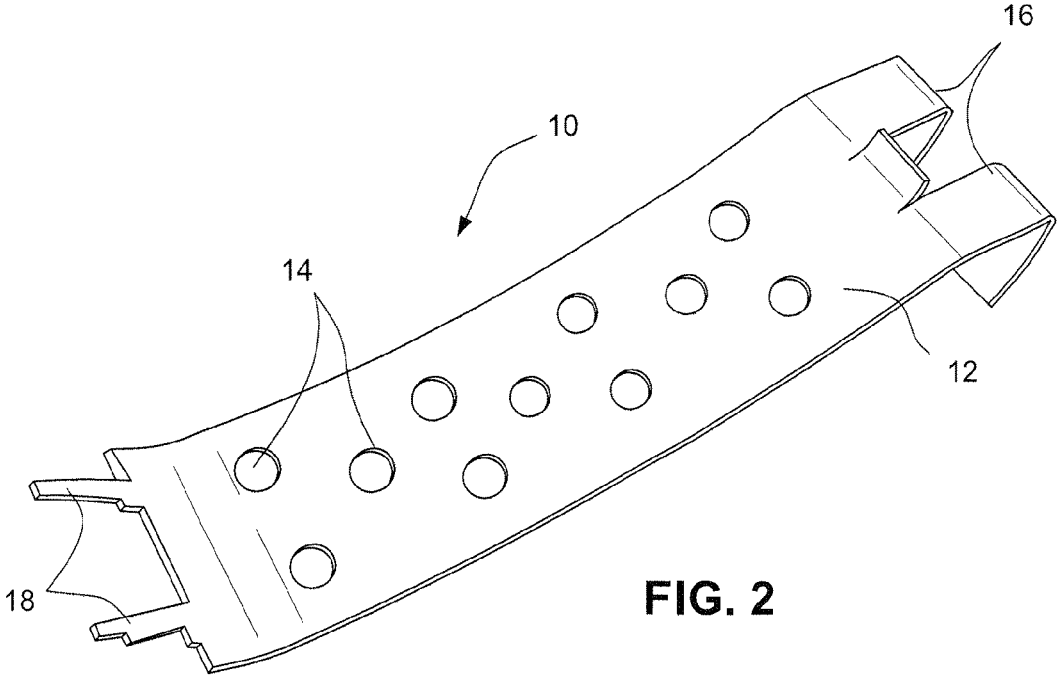
FIG. 2 is a perspective view of the bottom portion of the clip of the present invention.

As shown in FIGS. 1 and 2, the new and improved gutter guard clip 10 of the present invention comprises an elongated body 12 having a plurality of holes 14 therethrough of any suitable configuration, number or pattern.

The body 12 has one or more upwardly curved first tabs 16 at the front end thereof and one or more elongated second tabs 18 at the rear end thereof which may be of any suitable configuration depending on the size and shape of holes in a gutter guard panel in which they are to be engaged. As shown in FIG. 2, the front end of the panel 12 also has a downwardly extending or depending guide tab 20. The body 12 of the clip 10 may be curved upwardly from the front and rear ends thereof towards the middle portion thereof to facilitate the installation of the clip which will be more fully described hereinafter.

Figure 3:
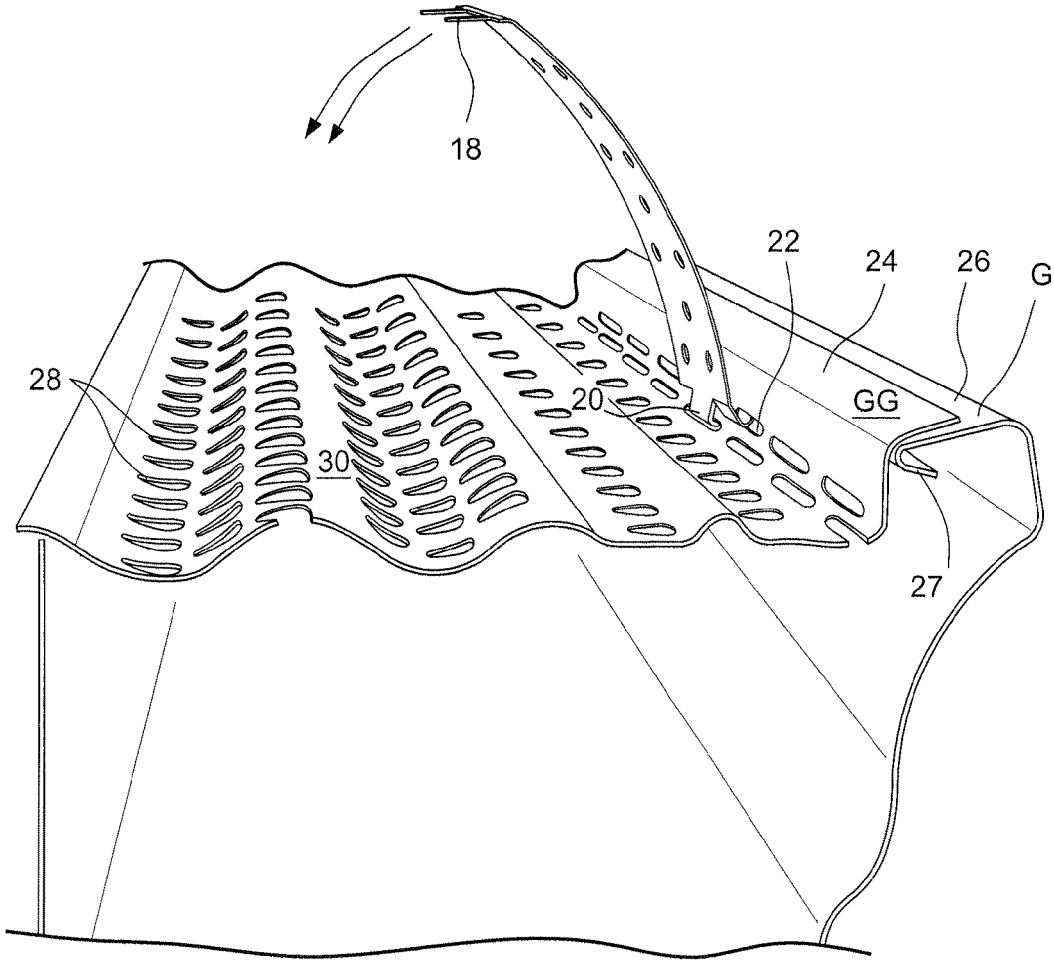
FIG. 3 is a perspective view of the clip of the present invention as it is first installed in openings in the front lip of a gutter guard that is positioned on a front lip of a gutter.
Figure 4:
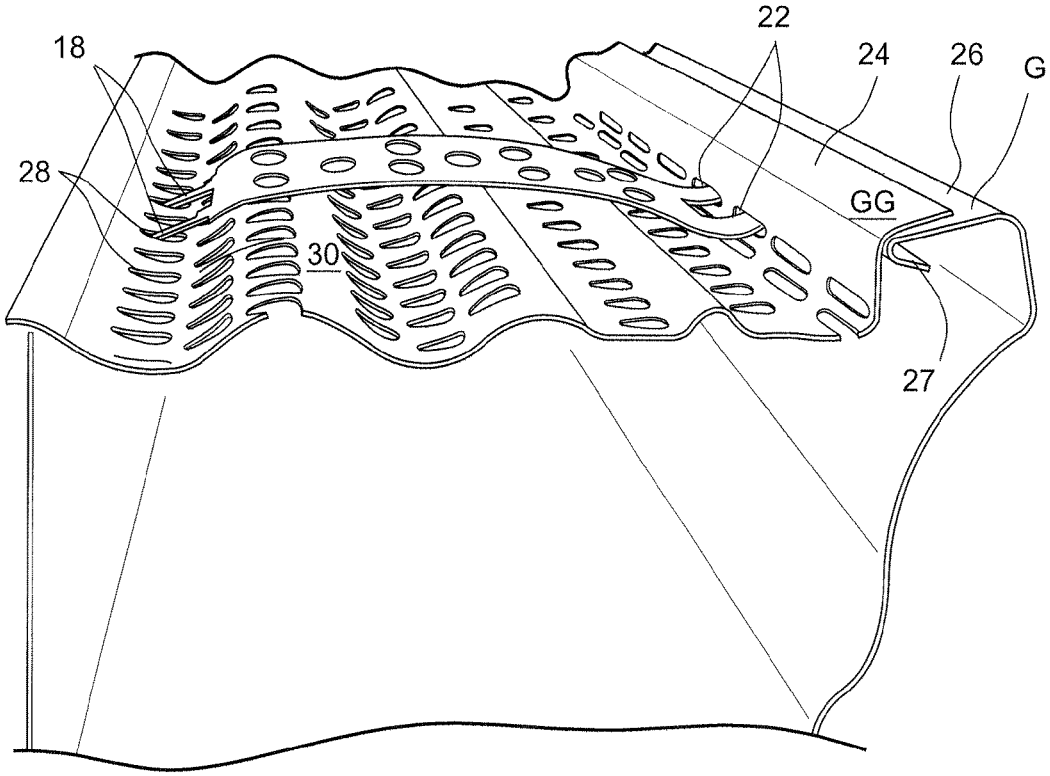
FIG. 4 is a perspective view similar to FIG. 3 showing the clip rotated downwardly from the position in FIG. 3 to the releasably locked position in FIG. 4 wherein the second tabs at the rear end thereof are received in openings in the gutter guard panel to removably retain the clip in the locked position of FIG. 4.
Figure 5:
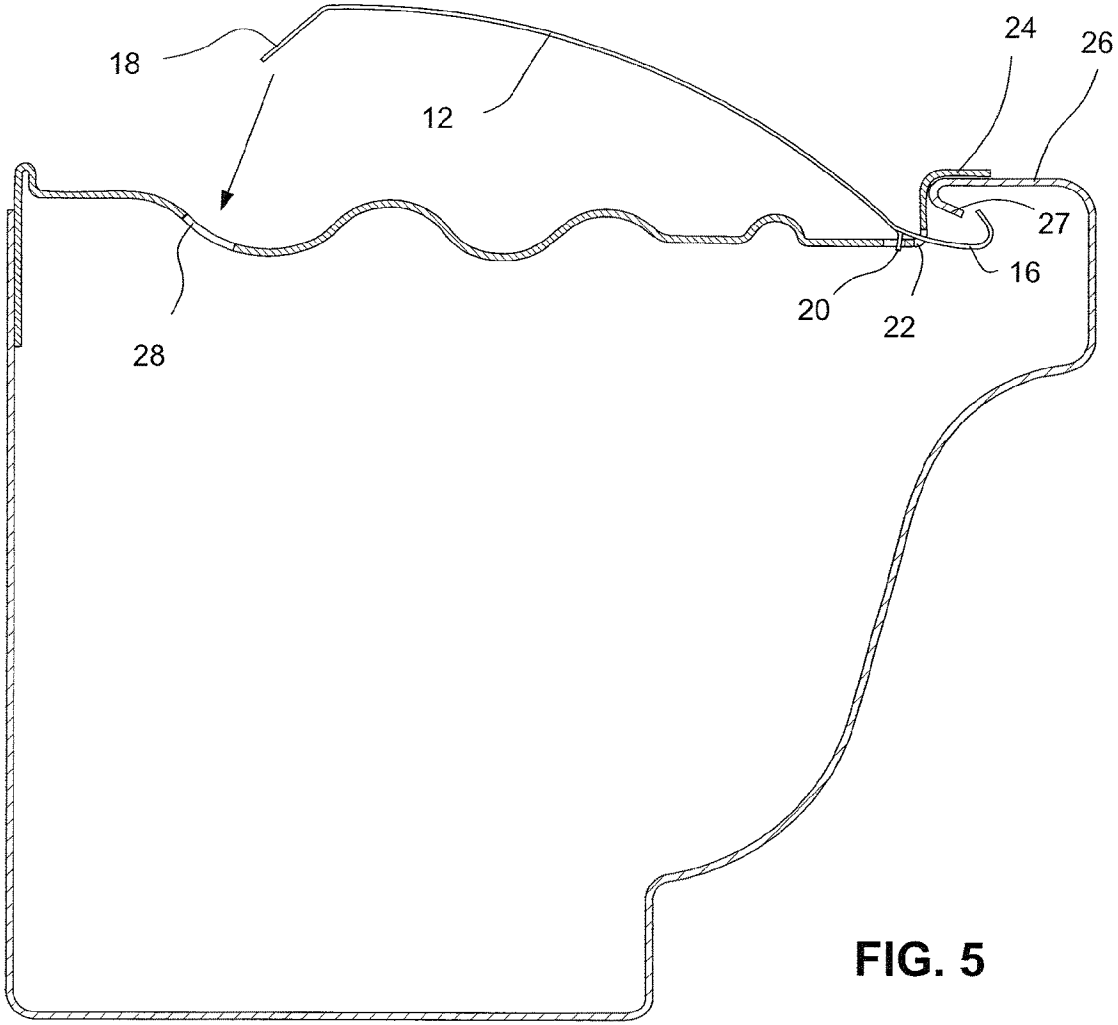
FIG. 5 is side elevational view in section of the clip, front lip of the gutter guard and front lip of the gutter in the position shown in FIG. 3.

Referring to FIGS. 3 and 5, the curved front tab or tabs 16 of the clip body 12 are inserted into an adjacent opening or openings 22 in the front lip 24 of the gutter guard GG after it is mounted on the front lip 26 of the gutter G having a downwardly and outwardly curved end portion 27. When the clip body 12 is rotated and bent downwardly (or in a counterclockwise direction) from the upright position of FIG. 3 to the locked position of FIG. 4, the curved front tabs 16 engage the downwardly and outwardly curved end portion 27 of the gutter G to removably secure the front lip 24 of the gutter guard GG to the front lip 26 of the gutter G. As further shown in FIG. 4, the rear tabs 18 of the clip body 12 removably engage adjacent openings 28 in the top panel 30 of the gutter guard GG to retain the clip 10 in the locked position of FIGS. 4 and 6 as a result of the resiliency of the clip body 12.

The rear tabs 18 may be of any suitable size and configuration so that they are removably retained in the holes 28 in the gutter guard 30. For example, if the holes 28 are of a tear drop shape, the rear tabs 18 would be of a size to fit within the enlarged end of the tear drop shape and to be resiliently moved therein to engage the narrower surrounding portion of the holes so as to be retained in the locked position shown in FIG. 4.

Figure 6:
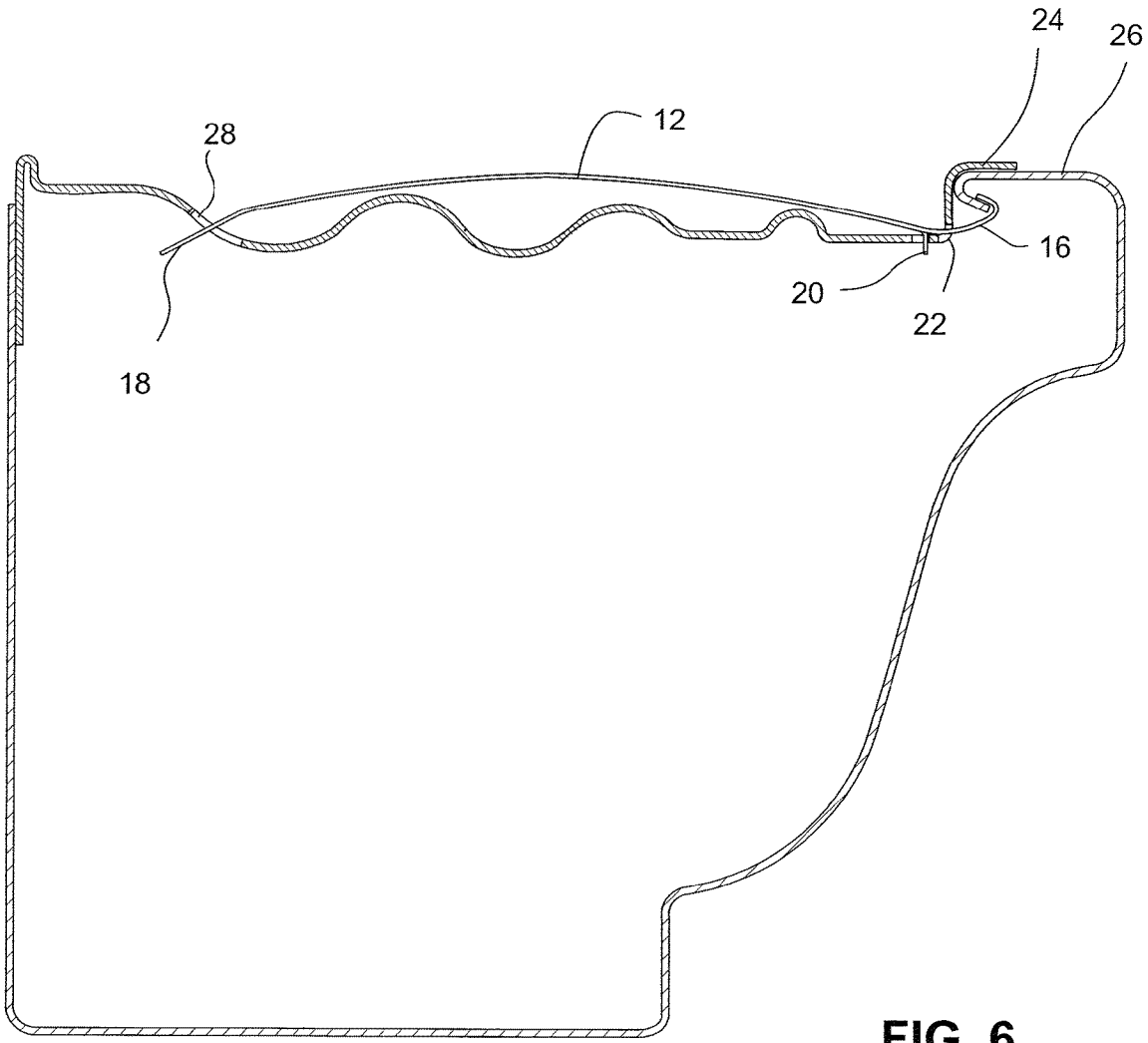
FIG. 6 is a side elevational view in section of the clip, the front lip of the gutter guard and the front lip of the gutter in the locked position shown in FIG. 4.

As shown in FIG. 6, the guide tab 20 at the front end of the clip body 12 engages an adjacent opening 22 near the front lip 24 of the gutter guard GG to properly align the clip 10 for engagement of the rear tabs 18 in the adjacent holes 28 of the gutter guard panel 30. Although the guide tab 20 facilitates the alignment of the clip 10 as it is rotated and bent to the locked position, it is noted that the guide tab 20 could be omitted and the clip 10 could still be moved from the upright position shown in FIG. 3 to the locked position shown in FIG. 4 to removably secure the front lip 24 of the gutter guard GG to the front lip 26 of the gutter G in accordance with the present invention.

Also in accordance with the present invention, the clip body 12 may have any suitable number of front curved locking tabs 16 and rear tabs 18 depending on the size of the clip 10 and the construction of the gutter guard and arrangement of the holes and openings therein in which the clip is to be mounted.

Figure 7:
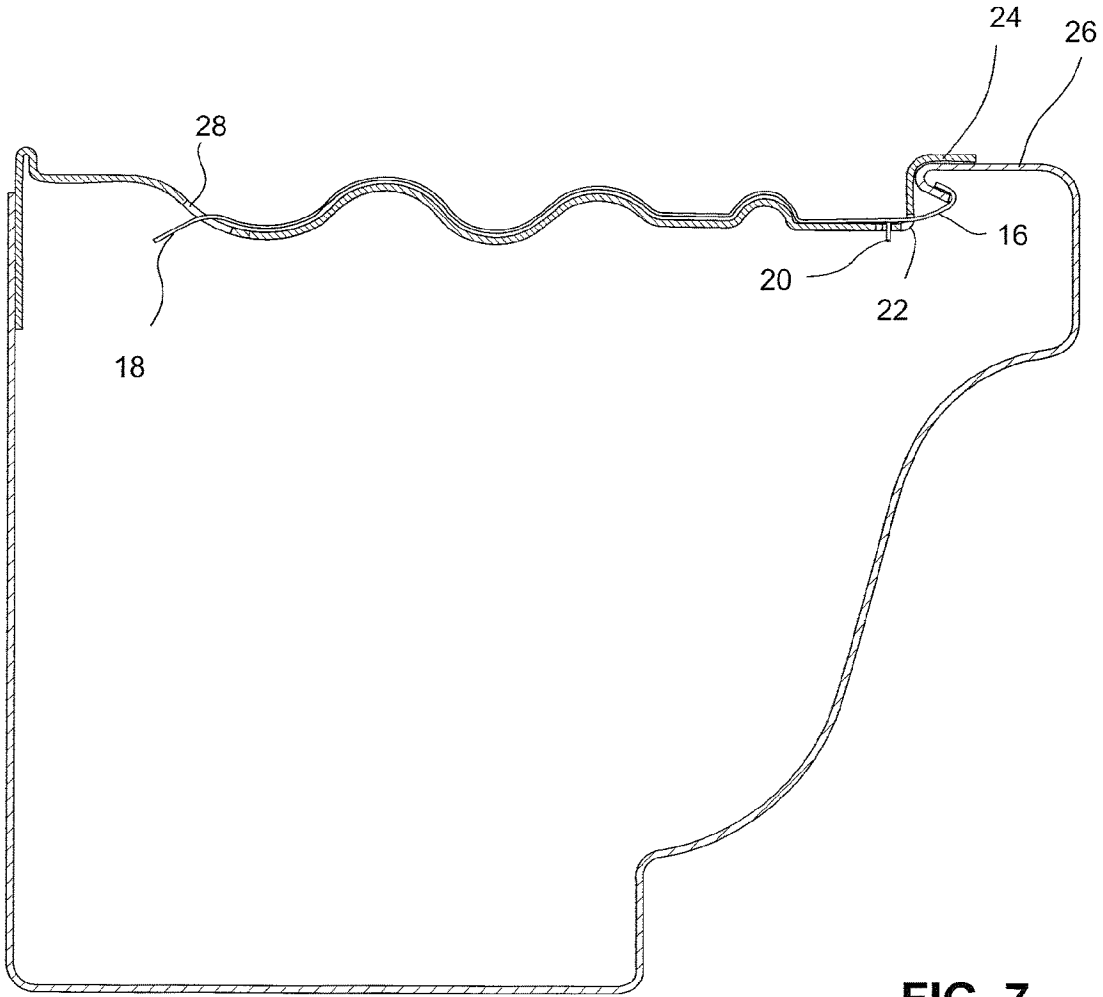
FIG. 7 is a side elevational view of a modified form of the clip wherein its elongated body has a shape generally corresponding to the shape of the underlying gutter guard panel so as to be closely adjacent thereto when in the locked position.

As shown in FIG. 7, the body 12 of the clip 10 may have a shape that is complementary to the shape of the underlying panel of the gutter guard GG to minimize any space therebetween when the clip 10 is in a locked position to prevent the collection of debris between the clip and the adjacent gutter guard panel.

Also, the holes 14 in the clip body 12 may have a shape and arrangement similar to the holes in the underlying gutter guard panel.

The invention claimed is:

1. A clip removably securing a front lip of a gutter guard having holes therethrough to the underlying front lip of a gutter having a downwardly and forwardly extending end portion, the clip comprising:

an elongated body of flexible and resilient material with a forwardly and upwardly extending first tab at a front end thereof and a rearwardly and downwardly extending second tab at a rear end thereof, first tab being inserted through a first hole at the front of the gutter guard with the body in an upwardly extending first position over the gutter guard so that the first tab is located adjacent to and beneath the end portion of the gutter, and the body being rotated and bent downwardly toward the gutter guard into a second position wherein the first tab is moved upwardly to engage the end portion of the gutter and the second tab is received within a second hole in the gutter guard adjacent thereto, the body being moved upwardly by its resiliency so that the second tab engages a lower surface of the gutter guard adjacent to the second hole to removably retain the body in the second position wherein the front lip of the gutter guard is secured to the underlying front lip of the gutter.

2. The clip of claim 1 wherein the body; first tab and second tab are of unitary construction and are formed of a flexible and resilient material.

3. The clip of claim 1 wherein the body is curved upwardly from the first and second tabs toward a middle portion thereof.

4. The clip of claim 1 wherein the body has a plurality of holes therethrough.

5. The clip of claim 4 wherein the holes through the body are in uniformly spaced relation.

6. The clip of claim 1 wherein the body has a shape that corresponds to a shape of an underlying panel of the gutter guard so as to be in close relation thereto when the clip is in the second position.

7. The clip of claim 6 wherein the body has holes therethrough that are in a pattern that corresponds to the holes in the gutter guard.

8. The clip of claim 1 wherein the body has a depending guide tab adjacent to the first tab, the depending guide tab being of a size and shape to enter an adjacent third hole in the underlying gutter guard as the body is moved to the second position to guide the movement of the body such that the second tab enters the second hole in the gutter guard when the body is in the second position.

9. The clip of claim 1 wherein the body has a plurality of first tabs at the front end thereof, the first tabs being positioned to enter first holes in the underlying gutter guard when the body is in the first position, and a plurality of second tabs at the rear end of the body that are positioned to enter second holes in the underlying gutter guard when the body is in the second position.

10. The clip of claim 9 wherein the body has a pair of laterally spaced first tabs at the front end thereof, and a depending guide tab is positioned between the first tabs and is of a size and shape to enter an adjacent third hole in the underlying gutter guard as the body is moved to the second position to guide the movement of the body such that the second tabs enter adjacent second holes in the gutter guard when the body is in the second position.

11. The clip of claim 10 wherein the body has a pair of laterally spaced second tabs at the rear end thereof.

12. The clip of claim 1 wherein the body is formed of spring stainless steel.

13. The clip of claim 1 wherein the body has a plurality of holes therethrough.

14. The clip of claim 13 wherein the body has a shape that corresponds to a shape of the underlying panel of the gutter guard so as to be in close relation thereto when the clip is in the second position.

15. The clip of claim 14 wherein the holes in the body are in a pattern that corresponds to the holes in the gutter guard.

* * * * *